United States Patent [19]

Gomi et al.

[11] Patent Number: 4,663,022

[45] **Date of Patent: * May 5, 1987**

[54] PROCESS FOR THE PRODUCTION OF CARBONACEOUS PITCH

[75] Inventors: Shimpei Gomi, Tokyo; Takuya Ueda, Zushi; Takao Nakagawa, Ichikawa; Masaharu Tachibana, Kawasaki, all of Japan

[73] Assignee: Fuji Standard Research, Inc., Tokyo, Japan

[ * ] Notice: The portion of the term of this patent subsequent to Apr. 8, 2003 has been disclaimed.

[21] Appl. No.: 815,923

[22] Filed: Jan. 3, 1986

[30] Foreign Application Priority Data

Jan. 16, 1985 [JP] Japan ..... 60-5578

[51] Int. Cl.[4] ..... C01G 51/02; C01G 9/14; C10C 1/00; C10C 3/00

[52] U.S. Cl. ..... 208/67; 208/39; 208/40; 208/72; 208/75; 208/106

[58] Field of Search ..... 208/39, 40, 67, 72, 208/106

[56] References Cited

U.S. PATENT DOCUMENTS 4,242,196 12/1980 Aiba et al. ..... 208/40
4,340,464 7/1982 Aiba et al. ..... 208/40
4,430,197 2/1984 Poynor et al. ..... 208/67
4,477,334 10/1984 Gomi et al. ..... 208/67
4,487,686 12/1984 Gomi et al. ..... 208/67
4,514,282 4/1985 Poynor et al. ..... 208/67
4,554,148 11/1985 Gomi et al. ..... 208/40

*Primary Examiner*—Andrew H. Metz
*Assistant Examiner*—Helane Myers
*Attorney, Agent, or Firm*—Pahl, Lorusso & Loud

[57] ABSTRACT

A continuous process for the production of carbonaceous pitch, including heat-treating an aromatic heavy oil in a first thermal cracking zone for obtaining a first cracked product, and introducing the first cracked product into a second thermal cracking zone where it is thermally cracked by direct contact with a gaseous heat transfer medium to form distillable cracked components and a mesophase-containing pitch. The liquid phase in the second thermal cracking zone, including the mesophase-containing pitch, is discharged therefrom and separated into a mesophase-rich pitch and a matrix pitch having a low concentration of mesophase. The mesophase-rich pitch is recovered while at least a portion of the matrix pitch is recycled to the second thermal cracking zone. The distillable cracked components are stripped from the liquid phase in the second thermal cracking zone with the heat transfer medium, and the resulting gas phase is withdrawn overhead therefrom and then separated into a light fraction and a heavy fraction. The heavy fraction is fed to the first thermal cracking zone.

9 Claims, 1 Drawing Figure

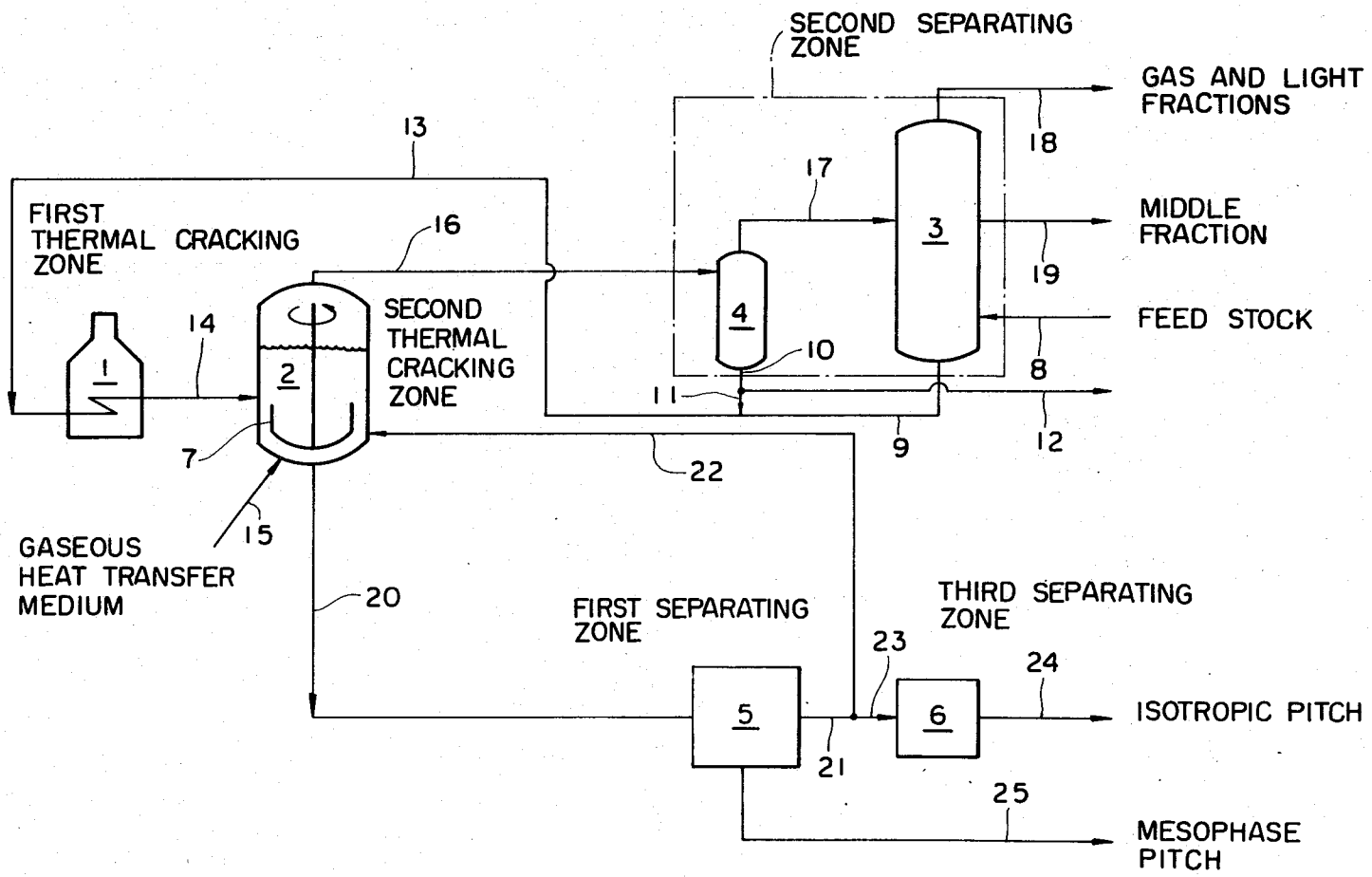
GAS AND LIGHT FRACTIONS
MIDDLE FRACTION
FEED STOCK
ISOTROPIC PITCH
MESOPHASE PITCH
SECOND SEPARATING ZONE
THIRD SEPARATING ZONE
FIRST SEPARATING ZONE
SECOND THERMAL CRACKING ZONE
FIRST THERMAL CRACKING ZONE
GASEOUS HEAT TRANSFER MEDIUM
1
2
3
4
5
6
7
8
9
10
11
12
13
14
15
16
17
18
19
20
21
22
23
24
25

PROCESS FOR THE PRODUCTION OF CARBONACEOUS PITCH

This invention relates to a process for the production of carbonaceous pitch useful for use as a precursor material for carbon fibers.

As precursor materials for carbon fibers, polyacrylonitrile fibers have been hitherto employed. Since the carbon fibers obtained from polyacrylonitrile fibers are expensive, however, a number of studies have been made in recent years to utilize carbonaceous pitch as raw materials for carbon fibers. As carbonaceous pitch for the production of carbon fibers, both optically isotropic and anisotropic pitches have been employed. Natural and synthetic pitches are generally isotropic in nature and afford isotropic carbon fibers having low-strength and low-modulus. On the other hand, anisotropic pitches can form carbon fibers having a strength and a modulus as high as those obtained from rayon or acrylic fibers. Therefore, the recent trend in the production of carbon fibers is towards the use of anisotropic pitches as starting materials. Thus, a number of processes have been hitherto proposed for the production of pitches useful as precursor materials for carbon fibers. However, most of the known processes should be carried out in a batch or semi-batch mode in order to avoid coking troubles.

In accordance with the present invention, there is provided a process for the production of carbonaceous pitch, comprising the steps of:

(a) feeding an aromatic heavy oil into a first thermal cracking zone for thermally cracking the aromatic heavy oil and for obtaining a first, thermally cracked product;

(b) introducing the first product into a second thermal cracking zone to which a gaseous heat transfer medium is supplied for direct contact with the liquid phase in the second thermal cracking zone, including the first product, so that the first product is further thermally cracked to form a second, thermally cracked product including distillable cracked components and a mesophase-containing pitch forming a part of the liquid phase, said distillable cracked components being stripped with the gaseous heat transfer medium from the liquid phase;

(c) discharging said liquid phase from the second thermal cracking zone for separating the liquid phase into a mesophase-rich pitch having a higher concentration of mesophase than the liquid phase and a matrix pitch having a lower concentration of mesophase than the liquid phase;

(d) recycling at least a part of said matrix pitch to said second thermal cracking zone;

(e) removing said stripped, distillable cracked components overhead from said second cracking zone and introducing same into a second separating zone for separating same into a light fraction and a heavy fraction;

(f) introducing at least a part of said heavy fraction into said first thermal cracking zone; and (g) recovering said mesophase-rich pitch.

The process of the present invention will now be described in detail below.

1. First Thermal Cracking Step

Any heavy hydrocarbon oil having a high aromatic carbon content may be used as a feed stock for producing a carbonaceous pitch according to the process of the present invention. Examples of such highly aromatic heavy oil include heavy petroleum hydrocarbons such as thermal cracking residues, catalytic cracking residues and catalytic hydrocracking residues and heavy coal hydrocarbon oil such as coal tar and heavy liquefied coal oil. The highly aromatic heavy oil preferably has a boiling point of at least 350° C., more preferably 400°-520° C., and an $f_a$ value (a ratio of the number of aromatic carbon atoms to the total number of carbon atoms) of 0.4-0.9, more preferably 0.5-0.8. The $f_a$ value may be calculated in accordance with the Brown-Ladner method from the results of an elementary analysis and proton NMR.

The aromatic heavy oil is fed to a first thermal cracking zone for thermally cracking same and for obtaining a first, thermally cracked product. In the first thermal cracking step, the aromatic heavy oil also undergoes polycondensation and aromatization to form pitch. The feed stock oil is preferably preheated to a temperature not higher than 350° C. before it is fed to the first cracking zone. It is also preferred that the feed stock is fed to the first cracking zone after the removal of a portion of its light hydrocarbon components as described hereinafter. Preferably, the first thermal cracking zone is a cracking furnace provided with a tubular reactor through which the aromatic heavy oil feed is streamed to undergo the thermal cracking. The thermal cracking in the first cracking zone is preferably carried out at a temperature of 450°-520° C., more preferably 480°-510° C., and a pressure of from normal pressure to 30Kg/cm$^2$G, more preferably at a pressure in the outlet port of the cracking zone of 1-5 Kg/cm$^2$G, for a period of time of 1-30 min, more preferably 1.5-20 min, while substantially preventing the occurrence of coking. It is advisable to add water to the aromatic heavy oil in an amount of 0.3-3% based on the weight of the heavy oil feed for the purpose of increasing the linear velocity of the aromatic heavy oil feed streamed through the tubular reactor and thereby preventing the occurrence of coking. As described hereinafter, at least a portion of a heavy fraction obtained in a fractionating step is introduced into the first cracking zone.

2. Second Thermal Cracking Step

The first, thermally cracked product obtained in the first thermal cracking step is continuously fed to a second thermal cracking zone where it is contacted with a gaseous heat transfer medium to further thermally crack the first product and to form a second, thermally cracked product including distillable cracked components and a mesophase-containing pitch which forms a liquid phase in the second thermal cracking zone. The distillable cracked components are stripped from the liquid phase with the gaseous heat transfer medium. The second thermal cracking step is preferably performed under a reduced pressure or under such a condition as to reduce the partial pressure of the distillable cracked components in the second thermal cracking zone.

The second thermal cracking zone is a continuous-type reactor preferably equipped with an agitator. The reactor is provided with a feed port through which the first cracked product from the first cracking zone is supplied thereto, a withdrawing port through which the distillable cracked components are removed therefrom together with the gaseous heat transfer medium, a discharge port through which the liquid phase is discharged therefrom, a recycling port through which a matrix pitch obtained from the liquid phase in a separating zone described hereinafter is recycled thereto and an injecting port through which the gaseous heat transfer medium is supplied thereto for contact with the liquid phase contained therein.

Thus, in the second cracking zone, the liquid phase including the first product from the first cracking zone and the matrix pitch from the separating zone is contacted with the heat transfer medium so that its distillable components are stripped and withdrawn overhead from the second cracking zone. At the same time, the liquid phase is subjected to thermal cracking conditions by direct heat exchange with the heat transfer medium, thereby to form the distillable cracked components (cracked light oil and cracked gas) and a pitch due to the polycondensation and aromatization reactions inherent to the thermal cracking. The distillable cracked components thus formed are stripped with the heat transfer medium from the liquid phase and removed from the second cracking zone together with the heat transfer medium. The thermal cracking in the second thermal cracking zone is carried out so that a substantial amount, preferably 5–25% by weight based on the liquid phase, of mesophase, preferably having a weight average particle diameter of 10–200 μm, is formed. The mesophase is homogeneously dispersed in the liquid phase (pitch phase) in the second cracking zone.

In order to form the pitch in which the mesophase is homogeneously dispersed, it is important that the distillable cracked components should be stripped from the pitch phase (liquid phase). If the thermal cracking is performed in the presence of a large amount of the volatile cracked components, the mesophase will grow large and coalesce with each other and coking will be apt to occur. By controlling the thermal cracking temperature and the partial pressure of the gas phase (i.e. the total partial pressure of the cracked gas and the oil vapor in the heat transfer medium), the pitch phase in which the mesophase with suitable properties, concentration and size is homogeneously dispersed may be produced, whereby the separation of the pitch phase into a matrix pitch and a mesophase-rich pitch as hereinafter described may be effectively performed.

The thermal cracking conditions in the second thermal cracking zone vary with the properties of the first cracked product fed from the first cracking zone. Generally, the thermal cracking in the second cracking zone is performed at a temperature of 410°–460° C., preferably 430°–450° C., a pressure or a partial pressure of the gas phase of 30–200 mmHg, preferably 40–100 mmHg, with a residence time of the liquid phase in the second cracking zone of 3–120 min, preferably 5–90 min.

The gaseous heat transfer medium is preferably a substantially oxygen-free, non-oxidative gas such as steam, a hydrocarbon gas, a perfect combustion waste gas or an inert gas such as nitrogen or argon and has generally a high temperature, preferably of 400°–800° C. Since the heat required for effecting the second thermal cracking step is mainly supplied from the products obtained in the first thermal cracking zone, the temperature of the gaseous heat transfer medium need not be very high.

For the purpose of preventing coking from occurring on the inside wall of the second thermal cracking reactor at a portion higher than the level of the liquid phase, that portion of the reactor may be cooled by direct or indirect contact with cooling water. Alternatively, to achieve this purpose, the matrix pitch to be recycled to the second cracking zone may be introduced in such a manner as to travel on the inside wall of the reactor and to continually wet and wash the surface thereof. In either case, it is preferred that the temperature in the upper space of the liquid phase be 30°–60° C. lower than that of the liquid phase.

3. Separation of Liquid Phase

A portion of the liquid phase in the second cracking zone is continuously discharged therefrom and is introduced into a first separating zone where the liquid phase is separated into a matrix pitch and a mesophase-rich pitch such that the concentration of the mesophase is decreased in the matrix pitch and is increased in the mesophase-rich pitch as compared with the liquid phase. At least a portion of the matrix pitch is recycled to the second cracking zone, as described previously, for controlling both the concentration and average residence time of mesophase of the liquid phase in the second cracking zone and for thereby preventing the occurrence of coking. Thus, the recycling of the matrix pitch makes it possible to continuously perform the second thermal cracking step. It is preferred that the matrix pitch be recycled to the second thermal cracking zone in an amount so that the concentration of mesophase in the liquid phase is maintained at 5–25% by weight, more preferably 10–20% by weight. Too high a concentration of mesophase causes the occurrence of coking and the broadening of the residence time distribution of mesophase in the second thermal cracking zone, resulting in the unevenness of the physical properties of mesophase such as molecular weight distribution and softening point.

The mesophase-rich pitch is recovered, preferably continuously, as a pitch product useful as a precursor material for the production of high strength carbon fibers. Preferably, the mesophase-rich pitch has a mesophase content of at least 50% by weight, more preferably at least 80% by weight. If desired, a portion of the matrix pitch may be also recovered as a product. The matrix pitch product may be used, for example, as a precursor pitch for the production of carbon fibers after the removal of its mesophase by means of, for example, a filtering device.

The separation of the liquid phase into the matrix pitch and the mesophase-rich pitch may be effected by any known method generally utilized for liquid-solid separation, such as sedimentation and centrifuge.

It is advisable to reduce the residence time of the pitch phase in the separation zone. The temperature at which the separation is performed varies with the kind and the properties of the pitch to be treated and the properties of the mesophase-rich pitch product. Generally, the separation is performed at a temperature of 200°–450° C., preferably 300°–400° C. If, in the separation step, the liquid phase is subjected to a high temperature for a long period of time, there is a danger that the reactions resulting in the formation of pitch proceed further and coking troubles are liable to occur. Too low a separation temperature, on the other hand, will cause the increase of the viscosity of the liquid phase, resulting in the reduction in separating efficiency.

If desired, a portion of the heavy fraction and/or light fraction obtained in the fractionating step (second separating zone) described hereinafter may be fed to the first separating zone. By this, the viscosity and the temperature of the liquid phase to be treated may be lowered and, therefore, the separation may be efficiently conducted without encountering coking problems.

4. Separation of Distillable Cracked Components

The distillable cracked components (cracked gas and cracked oil) in the second thermal cracking zone are removed overhead therefrom together with the gaseous heat transfer medium and are fed to a second separating zone, generally one or more distillation towers, where they are separated into a heavy fraction, for example, with a boiling point of above 400° C., a middle fraction, for example, with a boiling point of 300°–400° C., a light fraction, for example, with a boiling point of below 300° C. and a gas fraction. The middle, light and gas fractions are recovered as products, while at least a portion of the heavy fraction is recycled to the first thermal cracking zone for the purpose of improving the yield of the pitch product and of controlling the properties of the pitch product.

The second separating zone may be constituted from two or more distillation towers connected in series. Thus, for example, the distillable cracked components from the second thermal cracking zone are first introduced into a primary distillation tower where they are separated into a bottom fraction and a lighter fraction. The lighter fraction is then fed to a secondary distillation tower where it is separated into desired fractions. The bottom fraction in the primary distillation tower is recycled to the first thermal cracking zone.

As described previously, the aromatic heavy oil feed stock is preferably fed to the first thermal cracking zone after the removal of its volatile components. This can be done by feeding the feed stock to the second separating zone. For example, when the second separating zone is formed from a single distillation tower, the feed stock is fed to a lower portion of the distillation tower thereby to distill off the volatile components contained in the feed stock. The bottom oil which is thus formed of (1) the heavy fraction separated from the distillable cracked components from the second thermal cracking zone and (2) the feed stock from which volatile components are removed, is introduced into the first thermal cracking zone. When the second separating zone is constituted from two distillation towers as described above, the feed stock is fed to a lower portion of the secondary distillation tower to which the distillate from the primary distillation tower is fed. The bottom oil in the secondary distillation tower, which is mainly composed of the feed stock from which volatile components are removed, is mixed with at least a portion of the bottom fraction in the primary distillation tower and the mixture is fed to the first thermal cracking zone. It is of course possible to introduce the feed stock directly into the first thermal cracking zone.

The process according to the present invention may be thus conducted in a fully continuous mode. Further, the main thermal cracking (second thermal cracking step) is effected in a single reactor under a condition so that the distribution of the residence time of the pitch phase in the reactor is concentrated in a narrow range. As a consequence, the thermal cracking may be conducted with a high yield of the pitch product while preventing the occurrence of coking. Further, the molecular weight distribution of the pitch product (mesophase-rich pitch and isotropic pitch) is concentrated to a narrow range. The pitch product is useful not only as a precursor material for carbon fibers but also as a binder, impregnater and a raw material for the production of easily graphatizable carbon materials such as needle coke.

One preferred embodiment according to the present invention will now be described below with reference to the accompanying drawing, in which:

the sole FIGURE is a flowdiagram illustrating an apparatus for carrying out the process of the present invention.

The reference numeral 1 designates a first thermal cracking zone, generally a tubular reactor disposed within a furnace, where an aromatic heavy oil is subjected to thermal cracking to obtain a first thermally cracked product. The first product is then passed to a second thermal cracking zone, generally a cylindrical reactor 2, through a line 14. A gaseous heat transfer medium is continuously supplied through a line 15 to the reactor 2 for direct contact with the liquid phase in the reactor 2 including the first product introduced from the reactor 1. The heat transfer medium serves to stir the liquid phase in the reactor 2, to maintain the temperature of the liquid phase within a predetermined range, and to strip distillable cracked components from the liquid phase. In the reactor 2, the first product is thus subjected to thermal cracking, generally under a reduced pressure or under such a condition that the partial pressure of the thermally cracked components is low, thereby to form mesophase pitch homogeneously dispersed in the liquid phase (pitch phase).

The distillable cracked components stripped from the liquid phase are withdrawn overhead from the second reactor 2 and fed to a primary distillation tower 4 through a line 16 together with the gaseous heat transfer medium. The liquid phase is continuously discharged from the second reactor 2 through a line 20 while maintaining the liquid level of the liquid phase in the reactor 2 at a predetermined level. Designated as 7 is a stirrer for homogeneously mixing the reaction mixture and for facilitating the stripping.

The liquid phase discharged from the reactor 2 is passed to a first separating zone 5, preferably a sedimentation vessel, a centrifuge or a combination of them, where it is separated into a mesophase-rich pitch and a matrix pitch. The mesophase-rich pitch is withdrawn through a line 25 and cooled for recovery as a solid pitch product. The matrix pitch is withdrawn through a line 21 and a portion thereof is recycled to the reactor 2 through a line 22 for undergoing a further thermal cracking treatment. If desired, a portion of the matrix pitch is diverted from the line 21 and fed to a mesophase separating zone (third separating zone) 6 through a line 23 to remove the mesophase contained therein. The resulting substantially mesophase-free isotropic pitch is discharged through a line 24 for recovery.

The distillable cracked components introduced into the primary distillation tower 4 are separated into a lighter fraction with a boiling point of, for example, 400° C. or below, and a bottom fraction with a boiling point of, for example, above 400° C. The lighter fraction (gas, light and middle franctions) is withdrawn through a line 17 and is introduced into a secondary distillation tower 3 where it is further fractionated into a gas fraction, a light fraction with a boiling point of 300° C. or below, a middle fraction with a boiling point of 300°–400° C., and a residual fraction. The gas and light fractions are withdrawn through a line 18 and the middle fraction is through a line 19.

Introduced through a line 8 into the lower portion of the secondary distillation tower 3 is the aromatic heavy oil feed stock. Thus, the light components contained in the feed stock are distilled off in the tower 3. The residual fraction which is mainly composed of the heavy components from the feed stock is discharged from the secondary distillation tower 3 through a line 9 and is mixed with at least a portion of the bottom fraction discharged through a lines 10 and 11 from the primary distillation tower 4. The mixture is then fed to the first thermal cracking zone 1 through a line 13. A portion of the bottom fraction is diverted from the line 10 and is recovered through a line 12.

The following examples will further illustrate the present invention.

EXAMPLE 1

A catalytic cracking residue was used as a starting material for the production of pitch according to the present invention. The feed stock had a specific gravity (15/4° C.) of 1.0467, a sulfur content of 0.9 wt %, an ash content of below 0.01 weight %, an H/C atomic ratio of 1.2, an $f_a$ value (in accordance with the Brown-Ladner method) of 0.59 and an average molecular weight (in accordance with the vapor pressure equilibrium method) of 260. The feed stock was continuously fed at a feed rate of 220 kg/hr to a secondary distillation tower for the removal of its volatile components. The residual fraction in the secondary distillation tower having a boiling point of above 400° C. was discharged therefrom at a rate of 100 kg/hr and was mixed with 30 kg/hr of a heavy fraction discharged from a primary distillation tower as described hereinafter. The mixture was then introduced into an external heat-type tubular reactor (first thermal cracking zone), where it was thermally cracked at a temperture of 510° C. , a pressure of 5 kg/cm$^2$G for 3 min. The resulting first product was fed to a perfect mixing-type cylindrical reaction vessel (second thermal cracking zone) having an inside volume of 150 liters and equipped with a stirrer and a scraper. A high temperature steam (700° C.) was continuously supplied from the bottom of the reaction vessel at a controlled rate so that the first product was thermally cracked at a temperature of 450° C. with a partial pressure of the cracked product in the gas phase of 180 mmHg.

A small amount of water way sprayed in the open space above the liquid level in the reaction vessel for maintaining the temperature of the gas phase at about 400° C., which was lower than that of the liquid phase, and for refluxing a part of the cracked oil thereby preventing the occurrence of foaming of the liquid level and the coking at the inside wall of the reaction vessel. The liquid phase within the reaction vessel was sufficiently stirred to maintain the mesophase particles formed as a result of the thermal cracking in a homogeneously dispersed state.

The liquid phase, which had the physical properties shown in Table 1, was continuously discharged therefrom at a rate of 129 kg/hr and fed to a sedimentation vessel-type separator where it was separated at 375° C. by gravity and centrifugal force into a mesophase-rich pitch containing about 98% of mesophase and a relatively mesophase-deficient pitch containing about 6% of mesophase. The latter pitch was discharged from the separator at a rate of 108 kg/hr and a portion (99 kg/hr) of the discharged pitch was recycled to the reaction vessel with the remainder portion (9 kg/hr) being cooled to 283° C. followed by separation of the mesophase to obtain a mesophase-free isotropic pitch. The mesophase-rich pitch and the isotropic pitch thus obtained had the properties as shown in Table 1.

TABLE 1

| | Properties of Pitch | | |
|---|---|---|---|
| Properties | Liquid Phase | Mesophase-Rich Pitch | Isotropic Pitch |
| Softening Point (°C.) | 199 | 259 | 197 |
| Volatile Matter Content (wt %) | 30 | 15 | 32 |
| Mesophase Content (%) | 19 | 98 | 0 |
| n-$C_7$S* (wt %) | 5 | 1 | 5 |
| n-$C_7$I** (wt %) | 95 | 99 | 95 |
| QI*** (wt %) | 8 | 27 | 0 |

*n-Heptane soluble content
**n-Heptane insoluble content
***Quinoline insoluble content The term "softening point" used herein is determined from a graph which shows the manner in which the pitch sample is softened when one gram of the pitch sample is heated at a rate of 6° C./min under a load of 10 kg/cm$^2$ by means of a Koka type flow tester (manufactured by Shimadzu Seisakusho, Ltd., Japan). The term "mesophase content" used herein is measured in the following manner: A mesophase pitch obtained is cooled under a predetermined condition to obtain a solidified pitch sample. The pitch sample is embedded in a resin (Resin #101 manufactured by Marumoto Industries Co., Ltd., Japan) for fixation of the pitch in the conventional manner. The sample is then polished by means of an automatic optical polisher (manufactured by Marutoh Inc., Japan) until the surface of the pitch becomes mirror suitable for a photomicrographic analysis. A polarized light photomicrograph at a magnification of 400× of the polished pitch sample is taken for the determination of its mesophase content in terms of the area (%) of the optically anisotropic domans.

The mesophase-rich pitch was spum into fibers and rendered infusible in the air at 280° C. The infusible fibers were calcined at 1000° C. in the atmosphere of nitrogen to obtain cargon fibers having a fiber diameter of 9.5 μm, a tensile strength of 28.0 ton/cm$^2$, *a modulus of* 1400 ton/cm$^2$ and an elongation of 2.0%.

The overhead product obtained in the reaction vessel was continuously passed to the primary destillation tower at a rate of 100 kg/hr, where it was separated into a lighter fraction having a boiling point of below 400° C. and a bottom fraction having a boiling point of 400° C. or more. The lighter fraction was fed at a rate of 38 kg/hr to the secondary distillation tower while the bottom fraction (heavy fraction) was discharged from the primary distillation tower at a rate of 62 kg/hr of the discharged heavy fraction was mixed with the residual fraction from the secondary distillation tower, as described previously, and the mixture was introduced into the first cracking zone. The remaining 32 kg/hr of the heavy fraction was recovered. The distillation in the second distillation tower produced 65 kg/hr of a light and gas fraction (b.p. of below 350° C.), 93 kg/hr of middle fraction (b.p. of 350°–400° C.) and 100 kg/hr of heavy fraction (b.p. of 400° C. or more). The overall yields of respective cracked products are shown in Table 2.

TABLE 2

| | |
|---|---|
| Cracked gas ($C_4$ −) | 7 |
| Light oil ($C_4$ + to bp 350° C.) | 58 |
| Middle oil (bp 350–400° C.) | 93 |
| Heavy oil (bp above 400° C.) | 32 |
| Mesophase pitch | 21 |
| Isotropic pitch | 9 |

What is claimed is:

1. A process for the production of carbonaceous pitch, comprising the steps of:

(a) feeding an aromatic heavy oil to a first thermal cracking zone for thermally cracking the aromatic heavy oil and for obtaining a first, thermally cracked product;

(b) introducing the first product into a second thermal cracking zone to which a gaseous heat transfer medium is supplied for direct contact with the liquid phase in the second thermal cracking zone, including the first product, so that the first product is further thermally cracked to form a second, thermally cracked product including distillable cracked components and a mesophase-containing pitch forming a part of the liquid phase, said distillable cracked components being stripped with the gaseous heat transfer medium from the liquid phase;

(c) discharging said liquid phase from the second thermal cracking zone into a first separating zone for separating the liquid phase into a mesophase-rich pitch having a higher concentration of mesophase than the liquid phase and a matrix pitch having a lower concentration of mesophase than the liquid phase;

(d) recycling at least a portion of said matrix pitch to said second thermal cracking zone;

(e) removing said stripped, distillable cracked components overhead from said second cracking zone and introducing same into a second separating zone for separating same into a light fraction and a heavy fraction;

(f) introducing at least a part of said heavy fraction into said first thermal cracking zone; and (g) recovering said mesophase-rich pitch.

2. A process as claimed in claim 1, further comprising introducing a portion of said matrix pitch obtained in step (c) into a third separating zone to separate the mesophase contained therein, thereby to obtain substantially mesophasefree isotropic pitch.

3. A process as claimed in claim 1, wherein the aromatic heavy oil is fed to the first thermal crackihg zone after the removal of its volatile components.

4. A process as claimed in claim 3, wherein said second separating zone is composed of a single distillation tower and the aromatic heavy oil is fed to said distillation tower to drive off the volatile components, the resulting aromatic heavy oil having the volatile components removed being introduced into the first thermal cracking zone as a mixture with said heavy fraction.

5. A process as claimed in claim 3, wherein said second separating zone is composed of primary and secondary distillation towers and step (e) includes introducing said distillable cracked components into the primary distillation tower to separate same into a lighter fraction and a bottom fraction, and introducing said lighter fraction into the secondary distillation tower to separate it into said light fraction and a residual fraction, and wherein the aromatic heavy oil is fed to said secondary distillation tower to drive off the volatile components, the resulting aromatic heavy oil having the volatile components removed being discharged from said secondary distillation tower as a mixture with said residual fraction, said mixture being admixed with at least a portion of said bottom fraction, and said admixture being introduced into the first thermal cracking zone.

6. A process as claimed in claim 2, wherein the aromatic heavy oil is fed to the first thermal cracking zone after the removal of its volatile components.

7. A process as claimed in claim 6, wherein said second separating zone is composed of a single distillation tower and the aromtic heavy oil is fed to said distillation tower to drive off the volatile components, the resulting aromatic heavy oil having the volatile components removed being introduced into the first thermal cracking zone as a mixture with said heavy fraction.

8. A process as claimed in claim 6, wherein said second separating zone is composed of primary and secondary distillation towers and step (e) includes introducing said distillable cracked components into the primary distillation tower to separate same into a lighter fraction and a bottom fraction, and introducing said lighter fraction into the secondary distillation tower to separate it into said light fraction and a residual fraction, and wherein the aromatic heavy oil is fed to said secondary distillation tower to drive off the volatile components, the resulting aromatic heavy oil having the volatile components removed being discharged from said secondary distillation tower as a mixture with said residual fraction, said mixture being admixed with at least a portion of said bottom fraction, and said admixture being introduced into the first thermal cracking zone.

9. A process as claimed in claim 1, further comprising recovering said light fraction obtained in step (e).

* * * * *

UNITED STATES PATENT AND TRADEMARK OFFICE

CERTIFICATE OF CORRECTION

PATENT NO. : 4,663,022

DATED : May 5, 1987

INVENTOR(S) : Shimpei GOMI, Takuya UEDA, Takao NAKAGAWA and Masaharu TACHIBANA

It is certified that error appears in the above—identified patent and that said Letters Patent is hereby corrected as shown below:

Col. 8, line 42, "domans" should read -- domains --;

line 46, "cargon" should read -- carbon --;

line 47, "a modulus of" (stylized) should read -- a modulus of --;

line 50, "destillation" should read -- distillation -- line 57, "62 kg/hr of the" should read -- 62 kg/hr. 30 kg/hr of the --.

Col. 9, line 53, "crackihg" should read -- cracking --.

Signed and Sealed this

Twentieth Day of October, 1987

*Attest:*

DONALD J. QUIGG

*Attesting Officer*

*Commissioner of Patents and Trademarks*